US005314799A

United States Patent [19]

Takagi

[11] Patent Number: 5,314,799

[45] Date of Patent: May 24, 1994

[54] METHOD FOR PREPARING A FOGGED TYPED DIRECT POSITIVE SILVER HALIDE EMULSION

[75] Inventor: Yoshihiro Takagi, Kanagawa, Japan

[73] Assignee: Fuji Photo Film Co., Ltd., Kanagawa, Japan

[21] Appl. No.: 43,735

[22] Filed: Apr. 7, 1993

[30] Foreign Application Priority Data

Apr. 8, 1992 [JP] Japan ..... 4-087169

[51] Int. Cl.[5] ..... G03C 1/015

[52] U.S. Cl. ..... 430/569; 430/596; 430/598; 430/940

[58] Field of Search ..... 430/569, 596, 598, 940

[56] References Cited

U.S. PATENT DOCUMENTS

| | | | |
|---|---|---|---|
| 3,501,307 | 3/1970 | Illingsworth | 430/567 |
| 3,600,167 | 8/1971 | Judd et al. | 430/567 |
| 3,941,602 | 3/1976 | Depoorter et al. | 430/596 |
| 3,957,518 | 5/1976 | Vanassche et al. | 430/596 |
| 4,259,439 | 3/1981 | Tanaka et al. | 430/596 |
| 4,311,786 | 1/1982 | Steiger et al. | 430/596 |

FOREIGN PATENT DOCUMENTS

| | | | |
|---|---|---|---|
| 2512646 | 9/1975 | Fed. Rep. of Germany | 430/596 |

*Primary Examiner*—Janet C. Baxter

*Attorney, Agent, or Firm*—Sughrue, Mion, Zinn, Macpeak & Seas

[57] ABSTRACT

There is disclosed a method for preparing a direct reversal type silver halide light-sensitive emulsion which is used for a black-and-white light-sensitive material and has the improved photographic performances of a high sensitivity and a high contrast. The method comprises:

A method for preparing a fogging type direct positive silver halide emulsion comprising the steps of:

(a) forming an emulsion containing silver halide grains;

(b) fogging surfaces of the grains with a reducing agent to form a silver nuclei; and then (c) performing at least one of an adjustment of pH of the emulsion to 4.5 or less and an adjustment of pAg of the emulsion to 8.1 or more.

17 Claims, No Drawings

METHOD FOR PREPARING A FOGGED TYPED DIRECT POSITIVE SILVER HALIDE EMULSION

FIELD OF THE INVENTION

The present invention relates to a method for preparing a direct positive silver halide emulsion, which has been fogged in advance, specifically, a direct reversal type silver halide light-sensitive emulsion, which is used for a black-and-white light-sensitive material and has an improved photographic performance, including high sensitivity and high contract.

BACKGROUND OF THE INVENTION

The silver halide emulsion used for the direct positive silver halide photographic light-sensitive material according to the present invention is fogged in advance, and a solarization or a Herschel effect is utilized to break fogging nuclei by exposure, whereby a positive image is formed. The direct positive light-sensitive material can include a photographic light-sensitive material having a high sensitivity, in which a desensitizing dye is used, as shown in JP-B-50-3938 (the term "JP-B" as used herein means an examined Japanese patent publication) and JP-B-50-3937, and a light-sensitive material for daylight which can be handled in the daylight, as shown in JP-A-62-234156 (the term "JP-A" as used herein means an unexamined Japanese patent application) and JP-A-61-251843. The present invention relates to the silver halide emulsion used for these light-sensitive materials.

Usually, a direct positive type light-sensitive material is fogged with a reducing agent after the formation of the grains so that a reduced Ag nucleus is formed on the surface thereof to the extent that optical bleaching is possible. Obtaining the performance of high sensitivity and high contrast requires suppressing the degree of fogging and equalizing fogging among the grains. However, suppressing the degree of fogging to increase sensitivity makes it difficult to increase Dmax and softens gradation.

Suppressing the degree of fogging in order to suppress Dmin may result in a Dmax which is not sufficiently increased and a gradation which is liable to become soft.

Further, in a direct positive light-sensitive material for photographing, since it is required to increase sensitivity, the degree of fogging by a reducing agent can not be strengthened and, therefore, the resulting Ag nuclei are fine and unstable.

Meanwhile, in a direct positive light-sensitive material for daylight, the need for a decrease in sensitivity requires an intensification of the degree of fogging with a reducing agent and, therefore, the resulting Ag nuclei are not easily bleached by exposure and the Dmin is liable to increase.

It is proposed in JP-B-50-3978 to use a gold compound to increase stability of the Ag nuclei. However, even the use of a gold compound does not overcome the fact that the Ag nuclei remain insufficiently stable and Dmin is liable to increase.

Further, the development processing of the direct positive light-sensitive material has been carried out by a lith development (for example, HS-5 (developer) manufactured by Fuji Photo Film Co., Ltd.). In recent years, however, the trend for a processing system has been changed. That is, a rapid processing aptitude such as an RAS (a rapid access) processing and Hybrid processing (for example, Grandex manufactured by Fuji Photo Film Co. and Ultratec manufactured by Eastman Kodak Co., Ltd.) have been required. Thus, it is desired to achieve excellent performance with respect to Dmax, Dmin and high contrast as close as possible to those achieved with the lith processing.

SUMMARY OF THE INVENTION

An object of the present invention is to provide a method for preparing a direct positive silver halide emulsion having a high sensitivity, capable of providing high Dmax, low Dmin and a high contrast. Another object of the present invention is to provide a method for preparing a direct positive silver halide emulsion having good storage performances.

The above objects and advantages have been obtained by the following method.

A method for preparing a fogging type direct positive silver halide emulsion comprising the steps of:

(a) forming an emulsion containing silver halide grains;

(b) fogging surfaces of the grains with a reducing agent to form a silver nuclei; and then (c) performing at least one of an adjustment of pH of the emulsion to 4.5 or less and an adjustment of pAg of the emulsion to 8.1 or more.

DETAILED DESCRIPTION OF THE INVENTION

In the present invention, the preparation of the direct positive emulsion can be divided into three steps which occur after the ripening step which, in turn, occurs after the grain formation and precipitating-washing steps. The first step is a fogging step, the second one is a bleaching step and the third step is a stabilizing step. The respective steps will be explained below.

The direct positive type silver halide used in the present invention may be fogged by a known technique after removing the water soluble salts generated after precipitating the silver halide. Fogging may be provided either singly with a fogging agent (a reducing agent) or with a combination of a fogging agent, gold compound and a metal compound useful for stabilizing and improving photographic performances (e.g., Dmax, sensitivity, Dmin), which is electrically more positive than silver.

Generally, the fogging is conducted in a 0.5 to 15% preferably 1% to 10% aqueous gelatin solution.

The fogging agent useful for preparing the emulsion include, for example, formalin, hydrazine, a polyamine (e.g., triethylenetetramine and tetraethylenepentamine), thiourea dioxide, tetra(hydroxymethyl) phosphonium chloride, amine borane, a boron hydride compound, stannous chloride, and tin (II) chloride, and examples of the metal compound which is electrically more positive than silver include, soluble salts of gold, rhodium, palladium, and iridium, such as, potassium chloraurate, chlorauric acid, sodium chloraurate, gold sulfide, and gold selenide, ammonium palladium chloride, and sodium iridium chloride.

In general, the fogging agent is used in the ranging from $1.0\times10^{-6}$ to $1.0\times10^{-1}$ mole, preferably $5\times10^{-6}$ to $5\times10^{-2}$ mole per mole of silver halide.

In general, the metal conpound is used in an amount ranging from $1.0\times10^{-8}$ to $1.0\times10^{-4}$ mole, preferably $5\times10^{-8}$ to $5\times10^{-5}$ mole per mole of silver halide.

The fogging degree of the direct positive type silver halide emulsion fogged in advance can encompasses a wide range. This fogging degree relates to the kind and concentration of the fogging agent used, pH, pAg, and temperature of an emulsion at the point of providing fogging and the time for fogging as well as the silver halide composition and grain size of the silver halide emulsion used.

Fogging of a grain surface with a fogging agent is generally carried out at a pH of 4.8 or more, and not higher than 11, preferably from 5.0 to 10.0 pAg of 8.0 or less and not less than 5.0, preferably from 5.5 to 8.0 and a temperature of 40° C. or more and not higher than 85° C., preferably from 45° to 80° C. for about 2 to 200 minutes, preferably about 5 to 150 minutes.

After fogging, the bleaching step is performed which entails adjusting the pH to 4.5 or less, preferably not lower than 1.5, more preferably from 4.5 to 2.0 and/or the pAg to 8.1 or higher, preferably not higher than 11, and more preferably from 8.1 to 10.5. When pH is adjusted to 4.5 or less, pAg is preferably within the range of from 5 to 11, and more preferably 8.1 to 11, and when pAg is adjusted to 8.1 or more, pH is preferably within the range of from 1.5 to 11, and more preferably 1.5 to 4.5. By such a treatment, small size-fogged nuclei (Ag nuclei) on the grain surface which do not contribute to Dmax and to increase development proceeding properties are preferentially oxidized (bleached), whereby a high Dmax, a high sensitivity and a high contrast can be simultaneously achieved. Further, the oxidation of such useless Ag nuclei can lower Dmin. The amount of time for the bleaching step is preferably from about 1 to 120 minutes, more preferably from about 2 to 100 minutes, and the temperature during the bleaching step is preferably from 25° to 80° C., more preferably from 30° to 75° C. Prolongation of the time and elevation of the temperature can promote bleaching and these can be optimized so that the desired performances can be obtained.

In order to adjust the pH to 4.5 or lower acids such as acetic acid, hydrochloric acid, phosphoric acids, citric acid, sulfuric acid, malic acid, and salicylic acid may be used. Also, the pAg can be increased with halides such as bromide, chloride, and iodide (e.g., KBr, NaCl, KI), and organic compounds such as mercaptotetrazoles, mercaptotriazoles, benzothiazole-2-thiones, benzotriazoles, benzimidazoles, hydroxytetrazaindenes, and purines which are capable of combining with an Ag ion. Halides are preferred.

In order to stabilize the Ag nuclei it is necessary to raise the pH of the emulsion to a value within the range of 5.0 to 8.0, more preferably 5.3 to 7.8 and/or lower the pAg to a value within the range of 7.8 to 5.5, more preferably 7.4 to 5.8, at a temperature preferably of from 70° to 20° C., more preferably 60° to 25° C. to completion of the bleaching step.

Alkalis such as sodium hydroxide and potassium hydroxide can be used to adjust the pH and silver nitrate can be used to adjust the pAg.

Adjusting the pH and the pAg produces a stability compatible with the photographic characteristics such as a high sensitivity, high Dmax, low Dmin, and a high contrast.

For further stabilizing the Ag nuclei, a reducing agent such as formamidinesulfinic acid, hydrazine, a polyamine (e.g., triethylenetetramine and tetraethylenepentamine), formalin, phosphonium chloride, an amine borane compound, a boron hydride compound, stannous chloride, and tin chloride is preferably added, at an emulsion temperature of 50° C. or lower, preferably 40° C. or lower (preferably not lower than 20° C. in order to maintain the emulsion at a state capable of being stirred), in an amount of $10^{-8}$ to $10^{-2}$ mole/mole Ag, preferably $10^{-6}$ to $10^{-3}$ mole/mole Ag, and preferably at a pH of from 5.3 to 7.5 and at a pAg of from 5.8 to 7.4. Consitions (i.e., the type of the reducing agent, the pH, the pAg and the temperature of the emulsion) are selected or controlled so that fogging does not proceed in the emulsion.

The silver halide emulsion used in the present invention may be manufactured by any of an acid method, a neutral method and an ammonia method and the silver halide can iclude silver bromide, silver chloride, silver bromochloride, silver bromoiodide, and silver bromochloroiodide.

The silver halide grains advantageously have an average grain diameter of 0.01 to 2μ, preferably 0.02 to 1μ. The grain size frequency distribution may be either broad or narrow and is preferably narrow. In particular, a monodispersed emulsion in which 90%, preferably 95%, of the whole grain number falls within the grain size range of ±40%, preferably ±20%, of an average grain size is preferred. The silver halide grains either have a single crystal habit or a mixture of various crystal habits. The single crystal habit is preferred.

The direct positive type silver halide used in the present invention can contain inorganic desensitizers (that is, noble metal atoms contained in the silver halide grains) compounds and the organic desensitizers adsorbing on the surface of a silver halide grain singly or in combination thereof.

The inorganic desensitizers may be incorporated into the silver halide grains in the form of an aqueous solution of the water-soluble noble metal compound before, during or after formation of the grains. For example, chlorides of Group VIII metals in the periodic table, such as iridium and rhodium, in an amount of $10^{-7}$ to $10^{-2}$ mole, preferably $10^{-5}$ to $10^{-3}$ mole per mole of silver halide can be used in preparing the silver halide grains.

Other various photographic additives generally used can be incorporated into the direct positive silver halide photographic light-sensitive material of the present invention. These additives may include stabilizers, for example, triazoles, azaindenes, quaternary benzothiazolium compounds, mercapto compounds, and water soluble inorganic salts of cadmium, cobalt, nickel, manganese, gold, thallium, and zinc. Further, a hardener can be included, for example, aldehydes such as formalin, glyoxale and mucochromic acid, S-triazines, epoxides, aziridines, and vinyl sulfonic acid, as a coating aid, for example, saponin, sodium polyalkylenesulfonate, lauryl or oleyl monoether of polyethylene glycol, amylized alkyltaurine, and fluorine-containing compounds. Also, sensitizers can be included, for example, polyalkylene oxide and derivatives thereof. In addition, color couplers, whitening agents, UV absorbers, anti-septic agents, matting agents, and anti-electrification agents can be used according to necessity.

In the present invention, a dye can be used to prevent the generation of irradiation and fog under a safelight. The dye can have a main absorption in a visible wavelength region among a specific light-sensitive wavelength region of a silver halide emulsion. Among these dyes, those having a λmax falling within the range of 350 to 600 nm are preferred. The chemical structure of the dye is not specifically limited and example of the dye include oxonol dyes, hemioxonol dyes, merocyanine dyes, cyanine dyes, and azo dyes. A water soluble dye is useful for preventing a residual color after processing.

Further examples of the dye include, the pyrazolone dyes described in JP-B-58-12576, the pyrazolone oxonol dyes described in U.S. Pat. No. 2,274,782, the diaryl azo dyes described in U.S. Pat. No. 2,956,879, the styryl dyes and butadienyl dyes described in U.S. Pat. Nos. 3,423,207 and 3,384,487, the merocyanine dyes described in U.S. Pat. No. 2,527,583, the merocyanine dyes and oxonol dyes described in U.S. Pat. Nos. 3,486,897, 3,652,284 and 3,718,472, enaminohemioxonol dyes described in U.S. Pat. No. 3,976,661, and the dyes described in British Patents 584,609 and 1,177,429, JP-A-48-85130, JP-A-49-99620, and JP-A-49-114420, and U.S. Pat. Nos. 2,533,472, 3,148,187, 3,177,078, 3,247,127, 3,540,887, 3,575,704, and 3,653,905.

In the present invention, a cyanine dye is preferably used as a desensitizing dye. The preferred cyanine dye used can be represented by the following formulae (I) to (III).

First, the dyes represented by Formulae (I) to (III) will be explained.

Formula (I)

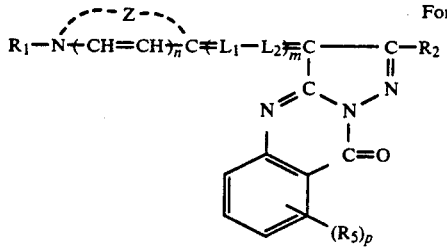

Formula (II)

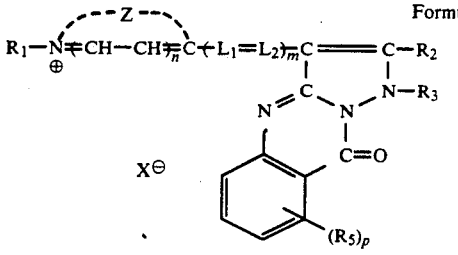

Formula (III)

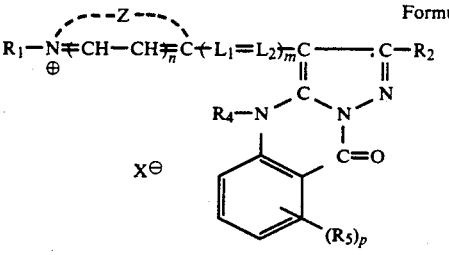

In Formulae (I) to (III), $R_1$ and $R_3$ each preferably has from 1 to 12 carbon atoms (including carbon atoms in substituents) each represent an alkyl group, for example, an unsubstituted alkyl group including, for example, methyl, ethyl, propyl, isopropyl, n-butyl, n-pentyl, and n-hexyl; a hydroxyalkyl group including, for example, β-hydroxyethyl and γ-hydroxypropyl; an acetoxyalkyl group including, for example, β-acetoxyethyl and γ-acetoxypropyl; an alkoxyalkyl group including, for example, β-methoxyethyl and γmethoxypropyl; a carboxyalkyl group including, for example, β-carboxyethyl, γ-carboxypropyl, δ-carboxybutyl, and ω-carboxypentyl; an alkoxy-carbonylalkyl group including, for example, β-methoxy-carbonylethyl and γ-ethoxycarbonylpropyl; a sulfoalkyl group including for example, β-sulfoethyl, γ-sulfopropyl, γ-sulfobutyl, and δ-sulfobutyl; an aralkyl group including, for example, benzyl and phenethyl; a sulfoaralkyl group including, for example, p-sulfophenethyl; a carboxyaralkyl group including, for example, p-carboxyphenethyl; and a vinylmethyl group.

$R_2$ represents a hydrogen atom or a substituent useful for a pyrazolo [5,1-b]quinazolone compound, including, for example, an alkyl group, for example, methyl, ethyl, propyl and benzyl; an alkoxyl group, for example, methoxyl and ethoxyl; a carboxyl group, an alkoxycarbonyl group, for example, methoxycarbonyl and ethoxycarbonyl; a hydroxyl group; and an aryl group, for example, phenyl and p-methoxyphenyl.

$R_4$ represents a hydrogen atom, an alkyl group including, for example, methyl, ethyl and propyl; a cycloalkyl group including, for example, cyclohexyl; or an aryl including as, for example, phenyl.

$L_1$ and $L_2$ each represent a methine group including, for example, —CH= and —$CR_6$= (Wherein $R_6$ represents an alkyl group including, for example, methyl, ethyl and ethoxyethyl; an aryl group including, for example, phenyl).

$L_1$ and $R_1$ may be combined via a methylene chain.

Z represents a group Of atoms necessary to form an cyanine heterocyclic nucleus. Examples of a nucleus include, an oxazoline nucleus, an oxazole nucleus, an benzoxazole nucleus, an naphthoxazole, a thiazoline nucleus, a thiazole nucleus, a benzothiazole nucleus, a naphthothiazole, a benzoselenazole nucleus, a naphthoselenazole nucleus, a pyridine nucleus, a quinoline nucleus, an isoquinoline nucleus, an imidazole nucleus, a benzimidazole nucleus, a naphthoimidazole nucleus, an indolenine nucleus, a quinoxaline nucleus, a naphthyridine nucleus, and a pyrroline nucleus.

$R_5$ represents a substituent useful for a pyrazolo [5,1-b]quinazolone compound, including, for example, a halogen atom (for example, a fluorine atom, a chlorine atom and a bromine atom), a lower alkyl group having from 1 to 4 carbon atoms (for example, methyl and ethyl), an alkoxyl group (for example, methoxyl and ethoxyl), an aryl group (for example, phenyl), a carboxyl group, an alkoxycarbonyl group (for example, methoxycarbonyl), an acylamino group (for example, acetylamino group), an amino group, a nitro group, a phenoxy group, an alkylamino group, and a sulfonic acid group.

n represents 0 or 1, m represents 0, 1, or 2, and p represents 1, 2, 3 or 4.

X⊖ represents an acid anion including, for example, a chlorine ion, a bromine ion, an iodine ion, a thiocyanic acid ion, perchloric acid ion, a p-toluenesulfonic acid ion, a methylsulfuric acid ion, and an ethylsulfuric acid ion.

A particularly preferred dye is a dye represented by Formula (II) or (III), in which $R_2$ represents an alkyl group or an aryl group and, in Formula III, in which $R_4$ represents an alkyl group.

Examples of compounds represented by Formulae (I) to (III) are shown below but not limited thereto.

I-(1)
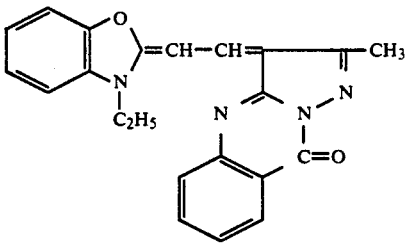
I-(2)
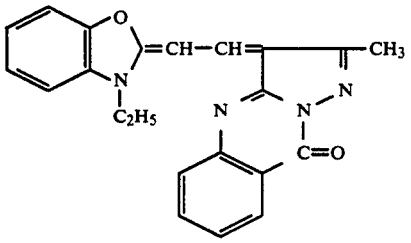
I-(3)
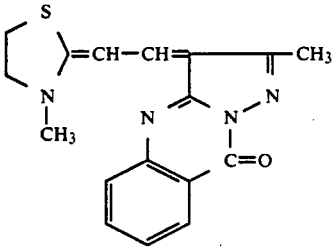
I-(4)
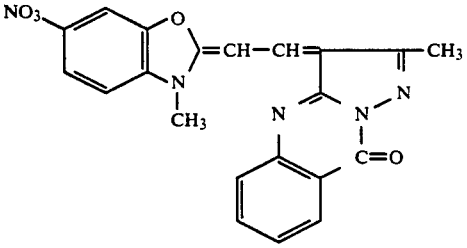
I-(5)
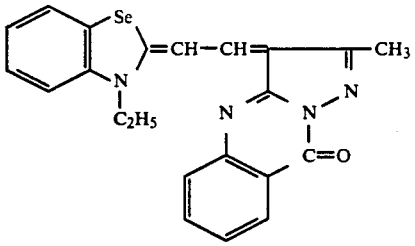
I-(6)
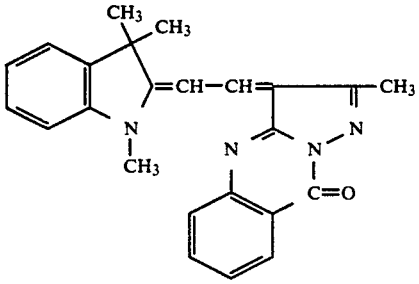
-continued
I-(7)
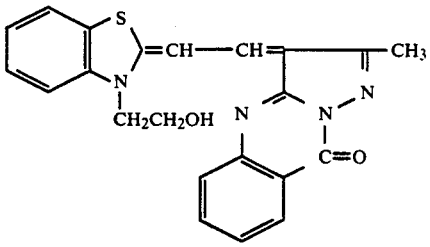
I-(8)
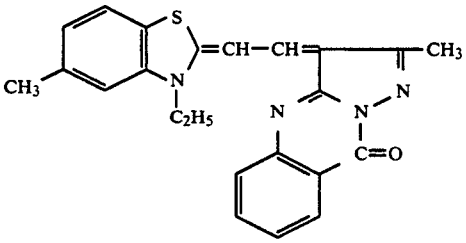
I-(9)
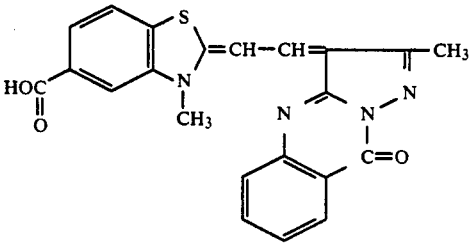
I-(10)
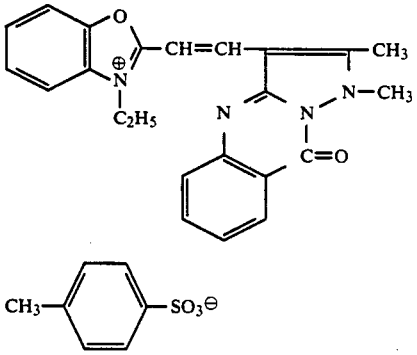
I-(11)
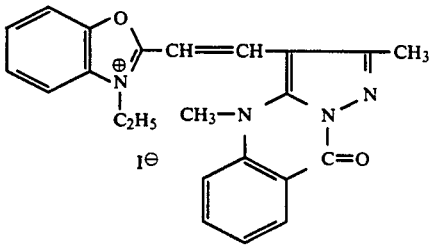
I-(12)
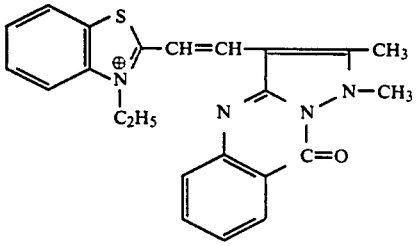

-continued
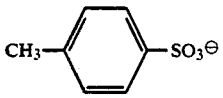
I-(13)
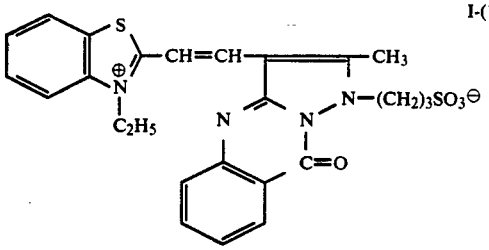
I-(14)
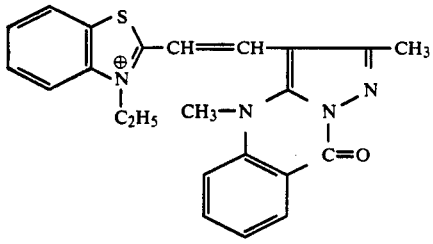
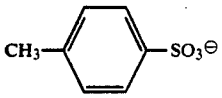
I-(15)
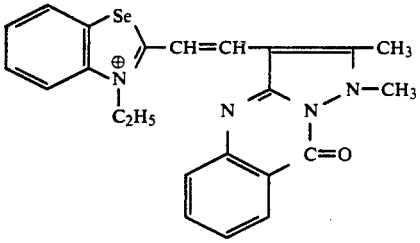
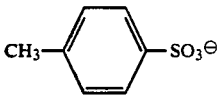
I-(16)
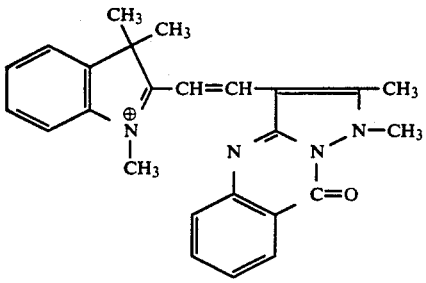
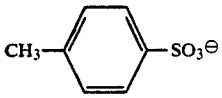
-continued
I-(17)
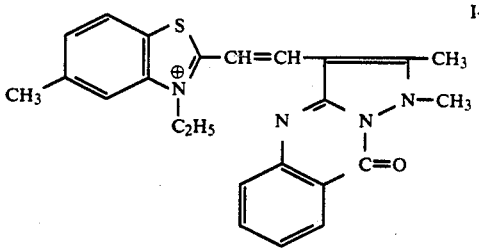
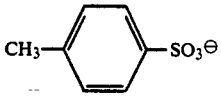
I-(18)
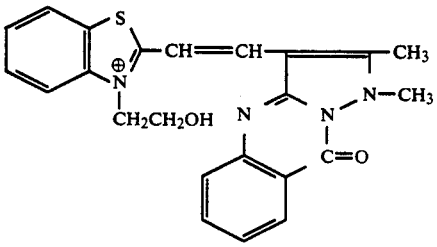
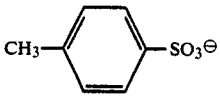
I-(19)
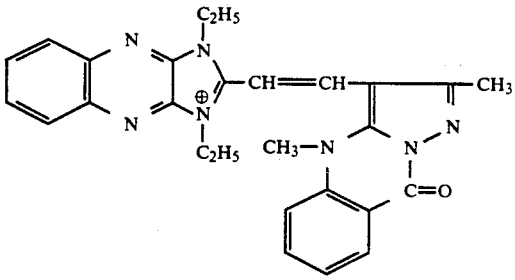
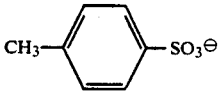
I-(20)
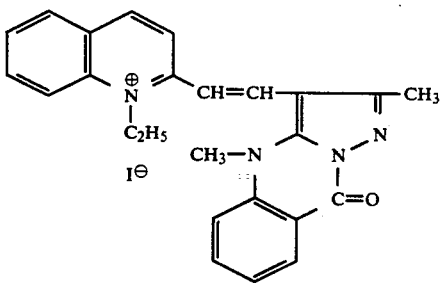
I-(21)
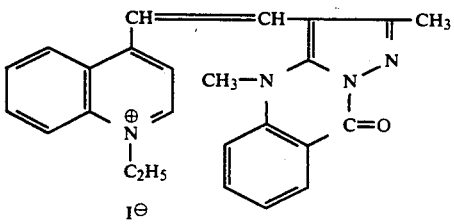

-continued

I-(22)

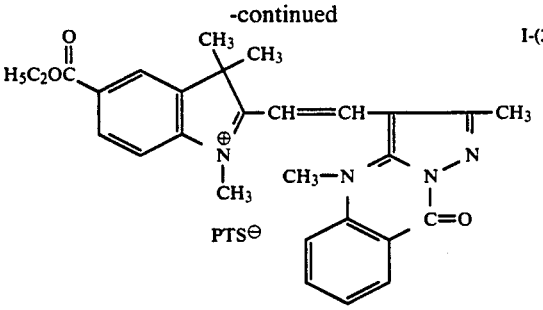

The dyes described above are incorporated into a silver halide emulsion layer and the addition amount is in the range of 50 mg to 2 g per mole of silver halide.

Excellent results can be obtained according the objects of the present invention by incorporation of or by processing the photographic material in the presence of a compound in which a sulfur atom forms a bond with a silver ion to adsorb on the surface of a silver halide crystal, such as mercaptotetrazoles, mercaptotriazoles, mercaptothiadiazoles, and benzothiazole-2-thiones, and a compound in which a nitrogen atom forms a bond with a silver ion to adsorb on the surface of a silver halide crystal, such as benzotriazoles, benzimidazoles, hydroxytetrazaindenes, and purines.

Of the above-described sulfur-containing compounds, a preferred compound is a compound having a mercapto group and especially that represented by the following Formula (IV):

Z-SM (IV)

wherein Z represents an aliphatic group (for example, a substituted alkyl group such as carboxyethyl, hydroxyethyl, and diethylaminoethyl), an aromatic group (for example, phenyl) or a heterocyclic group (preferably a 5- or 6-membered ring having at least one of N, O, S and Se atoms as hetero-atom).

The total carbon number of the aliphatic group and aromatic group is preferably 18 or less. M represents a hydrogen atom, an alkali metal atom such as Na and K, or $NH_4$.

Among these compounds, particularly preferred is a heterocyclic residue containing one or more nitrogen atoms in the molecule The total carbon atom number is preferably 30 or less, more preferably 18 or less.

The heterocyclic residue represented by Z may be further condensed. Preferred examples of the residue include residues of imidazole, triazole, tetrazole, thiazole, oxazole, selenazole, benzimidazole, benzoxazole, benzothiazole, thiadiazole, oxadiazole, benzoselenazole, pyrazole, pyrimidine, triazine, pyridine, naphthothiazole, naphthoimidazole, naphthoxazole, azabenzimidazole, purine, and azaindene (for example, triazaindene, tetrazaindene and pentazaindene).

Further, the aliphatic gorup, aryl gorup, heterocyclic residues and condensed rings may be substituted with suitable substituents.

For example, the substituent can include an alkyl group (for example, methyl, ethyl, hydroxyethyl, trifluoromethyl, sulfopropyl, dipropylaminoethyl, and adamantane), an alkenyl group (for example, allyl), an aralkyl group (for example, benzyl and p-chlorophenethyl), an aryl group (for example, phenyl, naphthyl, p-carboxyphenyl, 3,5-dicarboxyphenyl, m-sulfophenyl, p-acetamidophenyl, 3-capramidophenyl, p-sulfamoylphenyl, m-hydroxyphenyl, p-nitrophenyl, 3,5-dichlorophenyl, and 2-methoxyphenyl), a heterocyclic residue (preferably 5- or 6-membered heterocyclic residue having at least one of N, O, S and Se atoms as hetero-atom, for example, pyridine), a halogen atom (for example, a chlorine atom and a bromine atom), a mercapto group, a cyano group, a carboxyl group, a sulfo group, a hydroxy group, a carbamoyl group, a sulfamoyl group, an amino group, a nitro group, an alkoxy group (for example, methoxy and ethoxy), an aryloxy group (for example, phenoxy), an acyl group (for example, acetyl), an acylamino group (for example, acetylamino, capramide, and methylsulfonylamino), a substituted amino group (for example, diethylamino and hydroxyamino), an alkyl- or arylthio group (for example, methylthio, carboxyethylthio, and sulfobutylthio), an alkoxycarbonyl group (for example, methoxycarbonyl), and an aryloxycarbonyl group (for example, phenoxycarbonyl). As shown above as examples, these substituents may be further substituted with, for example, a hydroxyl group, a methoxy group, a halogen atom, a sulfo group or a caroxyl group.

Further, a disulfide compound (Z-S-S-Z; wherein Z has the same meaning as that in Formula (IV)) may be used which decomposes to form a compound represented by Formula (IV).

The sulfur-containing compounds can include a compound having a thioketone group as represented by the Formula (V):

(V)

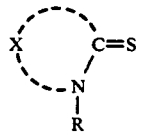

wherein R represents an alkyl group, an aralkyl group, an alkenyl group, an aryl group or a heterocyclic group; X represents a group of atoms necessary to form a 5- or 6-membered ring and may be condensed.

The heterocyclic ring formed by X is preferably 5- or 6-membered heterocyclic residue having at least one of N, O, S and Se atoms as hetero-atom, for example, thiazoline, thiazolidine, selenazoline, oxazoline, oxazolidine, imidazoline, imidazolidine, thiadiazoline, oxadiazoline, triazoline, tetrazoline, or pyrimidine as well as a heterocyclic ring condensed with a hydrocarbon ring or a heterocyclic ring, such as, benzothiazoline, naphthothiazoline, tetrahydrobenzothiazoline, benzimidazoline, and benzoxazoline.

Groups represented by R and X each may be substituted with the substituents described for the compound represented by Formula (IV) and they preferably have total carbon atoms of from 1 to 12.

Groups representative of R can include, as the alkyl group, for example, methyl, propyl, sulfopropyl, and hydroxyethyl; as the alkenyl group, for example, allyl; as the aralkyl group, for example, benzyl; as the aryl group, for example, phenyl, p-tolyl, and o-chlorophenyl; and as the heterocyclic group (which is preferably 5- or 6-membered heterocyclic residue having at least one of N, O, S and Se atoms as hetero-atom, for example, pyridyl.

Next, representative, but non-limiting, examples of the compound represented by Formula (IV) are shown below.

III-1
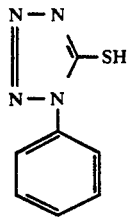
III-2
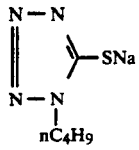
III-3
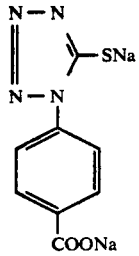
III-4
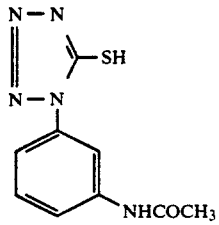
III-5
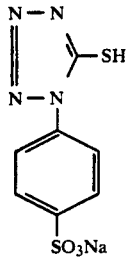
III-6
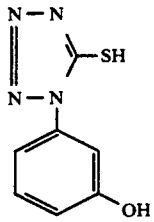
III-7
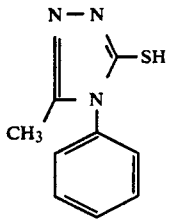
-continued
III-8
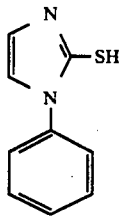
III-9
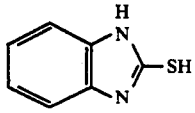
III-10
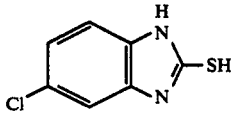
III-11
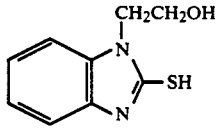
III-12
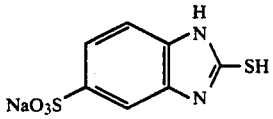
III-13
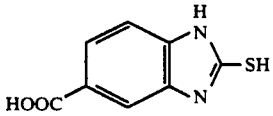
III-14
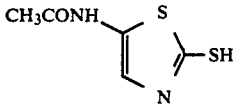
III-15
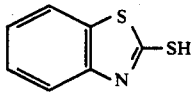
III-16
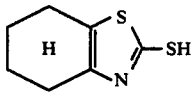
III-17
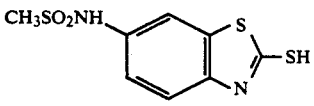
III-18
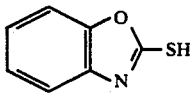
III-19
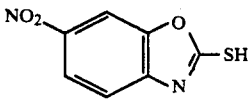

-continued

III-20

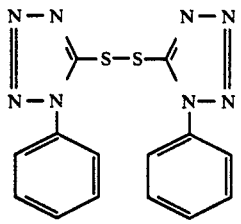

Next, representative, but non-limiting examples of the compounds represented by Formula (V) are shown below:

IV-1

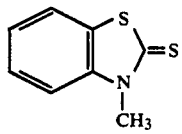

IV-2

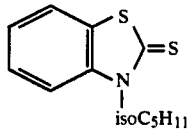

IV-3

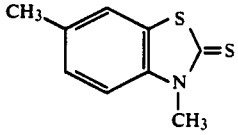

IV-4

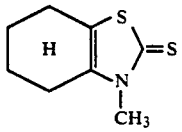

IV-5

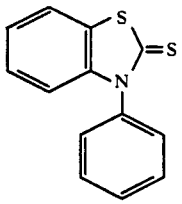

IV-6

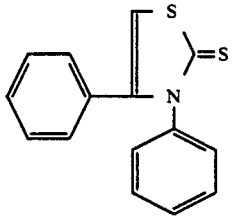

These compounds represented by Formulae (IV) or (V) can be obtained as described in *Stabilization of Photographic Silver Halide Emulsions,* E. J. Birr, Focal Press Co., 1974; Rer. *Prog. Appl. Chem.;* C. G. Barlow et al, Vol. 59, p. 159 (1974), *Research Disclosure,* 17643 (1978), JP-B-48-34169, JP-B-47-18008, and JP-B-49-23368, and *Beilsteln XII,* 394, IV, No. 121.

These sulfur compounds are added to a silver halide emulsion layer and the addition amount is preferably 0.1 to 100 mg/m$^2$, particularly 0.5 to 50 mg/m$^2$, above all 1.0 to 20 mg/m$^2$.

The developing agent used for the development processing of the silver halide photographic light-sensitive material according to the present invention can include, for example, the organic or inorganic developing agents and developing aids described in *The Theory of the Photographic Process,* E. K. Meath & T. H. James, Vol. 3, pp. 278–381 (1966), and can be used singly or in combination thereof. Preferred developing agents include ferrous oxalate; hydroxylamine; N-hydroxymorpholine; hydroquinones such as hydroquinone, hydroquinone mono-sulfonate, chlorohydroquinone, and t-butylhydroquinone; catechol; resorcine; pyrrogalole; amidol; phenidone, pyrazolidones such as 4-hydroxymethyl-4-methyl-1-phenyl-3-pyrazolidone; paraminophenols such as paraminophenol, glycine and methole; paraphenylenediamines such as paraphenylenediamine and 4-amino-N-ethyl-N-ethoxy-aniline, and ascorbic acid. More preferred examples are methole singly, the combination of phenidone and methole, the combination of methole and hydroquinone, the combination of phenidone, methole and t-butylhydroquinone, the combination of phenidone and ascorbic acid, and the combination of phenidone and aminophenol. However, the use of other combinations can provide almost the same good results and the present invention is not limited to the preferred examples.

The above-described developing agent, which can be incorporated into the developing solution used for the silver halide photographic light-sensitive material of the present invention, may be used generally in an amount of $1\times10^{-5}$ to 1 mole/liter of the developing solution. In particular, hydroquinone is used preferably in the amount of 20 g/liter or more, more preferably 25 g/liter or more.

In addition to the above-described developing agent, a preservative such as sulfite and hydroxylamine can be added to the developing solution. Also, compounds having the functions of pH controll and buffering used for a general black-and-white developing solution, such as caustic alkali, alkali carbonate, alkali borate, and amines, an inorganic development inhibitor such as potassium bromide, and an organic development inhibitor such as benzimidazole, benzotriazole, and nitroindazole, as described in British Patent 1,376,600, can be added to the developing solution.

The direct positive silver halide photographic light-sensitive material according to the present invention has various applications. For example, it can be used for various photographic light-sensitive materials for printing such as duplicating, reproduction and offset master, a specific photographic light-sensitive material for an X-ray photograph, a flash photograph and an electron beam photograph, and various direct positive photographic light-sensitive materials for general duplication, micro duplication, a direct positive color material, a quick stabilized material, a diffusion transfer material, a color diffusion transfer material, and a single bath developing-fixing. The direct positive silver halide photographic light-sensitive materials of the present invention have a high contrast and a very high stability under a storage over a long period of time and a high temperature and humidity.

The present invention will be explained below with reference to examples but the embodiments of the present invention are not limited thereto.

EXAMPLE 1

Citric acid was added to a gelatin aqueous solution maintained at 50° C., and an $AgNO_3$ aqueous solution and a halide aqueous solution were added thereto by a controlled double jet method under the presence of thioether ($HOCH_2CH_2SCH_2CH_2SCH_2CH_2OH$) over a period of 60 minutes, whereby a cubic monodispersed silver bromide emulsion having an average grain size of 0.24 μm was prepared.

This emulsion was desalted by a flocculation method and then gelatin was added thereto. After maintaining the temperature and pH at 65° C. and 6.0, respectively, formamidinesulfinic acid, in an amount of 0.008 millimole per mole of silver, was added and then chloroauric acid, in an amount of 0.0008 millimole per mole of silver, was added, followed by ripening for 60 minutes. After sampling emulsion a (emulsion a had a pAg of 7.2 and a pH of 6.2, respectively), KBr and phosphoric acid were added to settle the pAg and pH to 9.0 and 4.4, respectively, and the emulsion was ripened for 30 minutes at a temperature of 45° C. under the condition of bleaching a silver nucleus, followed by adding $AgNO_3$ and NaOH and setting the pAg and pH to 7.2 and 6.2, respectively. This emulsion was designated as emulsion b and stored at a temperature of 12° to 2° C.

Compound I-22 which was given as an example of a compound of Formulas (I) to (III) was added as a desensitizing dye as shown in Table 1 and the solution was coated on a polyethylene terephthalate film so that the coated amount of Ag became 2.7 g/m². A protective layer containing gelatin on amount of 1.2 g/m², 40 mg of amorphous SiO having an average grain size of 3μ as a matting agent, methanol silica in an amount of 0.1 g/m², a fluorinated surface active agent (Compound F shown below) and sodium dodecylbenzenesulfonate as a coating aid, and a KBr aqueous solution for adjusting pAg in a layer were simultaneously coated thereon. These light-sensitive materials are designated as A and B.

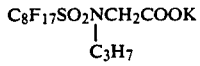

Compound F

Light-sensitive materials A and B were subjected to sensitometry exposure via a step wedge of $\Delta D=0.1$ and then to development processing with an automatic developing machine FG 660F manufactured by Fuji Photo Film Co., Ltd. in the following developing solution A and a fixing solution (GR-Fl manufactured by Fuji Photo Film Co., Ltd.) at the developing conditions of 34° C. and 30 seconds.

After processing, Dmin (miminum density), Dmax (maximum density), $S_{1.5}$ (sensitivity at the density of 1.5), and the average gradation $(G)_{0130}$ were measured. The results thereof are shown in Table 1.

The average gradation $(G)_{0130}$ is represented by the ratio of the density difference ($\Delta D=2.9$) to the difference ($\Delta \log E$) between the sensitivity in the density of 0.1 and the sensitivity in the density of 3.0.

It can be seen from the results shown in Table 1 that the emulsion prepared according to the method of the present invention provides a high sensitivity and a high gradation, in contrast to the comparative emulsion, while giving the same Dmax and a low Dmin.

TABLE 1

| Sample No. | Emulsion | Dye No. | Addition amount | D-max | D-min | $S_{1.5}$ | $G_{0130}$ |
|---|---|---|---|---|---|---|---|
| A (Comp.) | a | I-22 | 16 mg/m² | 5.3 | 0.05 | 100 | 6.5 |
| B (Inv.) | b | I-22 | 16 mg/m² | 5.3 | 0.03 | 125 | 8.2 |

| Developing solution A | |
|---|---|
| Hydroquinone | 50.0 g |
| N-methyl-p-aminophenol | 0.3 g |
| Sodium hydroxide | 18.0 g |
| 5-Sulfosalicylic acid | 30.0 g |
| Boric acid | 25.0 g |
| Potassium sulfite | 110.0 g |
| Sodium ethylenediaminetetracetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole) benzenesulfonate | 0.2 g |
| N-n-butyldiethanolamine | 15.0 g |
| Sodium toluenesulfonate | 8.0 g |
| Water was added to | 1 liter |
| pH was adjusted to (by adding potassium hydroxide) | 11.6 |

EXAMPLE 2

The same samples as light-sensitive material B prepared in Example 1 were prepared as shown in Table 2 and evaluated in the same manner as in Example 1, except that the pAg and pH were changed in accordance with the amounts of KBr and phosphoric acid in preparing emulsion be in order to prepare emulsions in which only the silver bleaching condition was changed.

As Shown by the results set forth in Table 2, a high sensitivity, a high contrast and low Dmin can be achieved while maintaining high Dmax (in a practical use, it is sufficient that Dmax 5.0 or more).

TABLE 2

| Sample No. | Emulsion | pAg | pH | Dmax | Dmin | $S_{1.5}$ | $G_{0130}$ |
|---|---|---|---|---|---|---|---|
| C (Inv.) | c | 7.2 | 4.4 | 5.3 | 0.04 | 102 | 6.6 |
| D (Inv.) | d | 7.8 | 4.4 | 5.3 | 0.04 | 104 | 6.7 |
| E (Inv.) | e | 8.0 | 4.4 | 5.3 | 0.04 | 105 | 7.0 |
| F (Inv.) | f | 8.5 | 4.4 | 5.3 | 0.04 | 110 | 7.5 |
| G (Inv.) | g | 8.8 | 4.4 | 5.3 | 0.03 | 124 | 8.0 |
| H (Inv.) | h | 9.5 | 4.4 | 5.2 | 0.03 | 130 | 8.1 |
| I (Inv.) | i | 10.0 | 4.4 | 5.1 | 0.03 | 135 | 7.9 |
| J (Inv.) | j | 8.0 | 4.2 | 5.3 | 0.04 | 108 | 7.0 |
| K (Inv.) | k | 8.5 | 4.2 | 5.3 | 0.04 | 113 | 7.5 |
| L (Inv.) | l | 9.0 | 4.2 | 5.2 | 0.03 | 128 | 8.2 |
| M (Inv.) | m | 10.0 | 4.2 | 5.1 | 0.03 | 136 | 7.9 |
| N (Inv.) | n | 8.5 | 3.8 | 5.3 | 0.03 | 115 | 7.5 |
| O (Inv.) | o | 8.5 | 3.5 | 5.2 | 0.03 | 118 | 7.5 |
| P (Inv.) | p | 8.5 | 3.0 | 5.1 | 0.03 | 122 | 7.5 |
| Q (Inv.) | q | 8.5 | 2.0 | 5.0 | 0.03 | 128 | 7.5 |
| R (Inv.) | r | 8.5 | 4.6 | 5.3 | 0.04 | 103 | 7.0 |
| S (Comp.) | s | 7.8 | 4.6 | 5.3 | 0.04 | 100 | 6.5 |

EXAMPLE 3

Emulsion a' was prepared in the same manner as in Example 1 except that KBr and phosphoric acid were not added, the silver bleaching step was not carried out and the pAg and pH were set at 7.2 and 6.2, respectively. Formamidinesulfinic acid in an amount per mole of Ag as shown in Table 3 was added to emulsions a' and b at 40° C. before storage. The emulsions were solidified in a refrigerator (8° C.) and then were used on the first day and 60th day to prepare the samples in the same manner as in Example 2. The samples were processed and evaluated in the same manner as in Example 2 to check the change in sensitivity.

The results shown in Table 3 illustrate that the addition of formamidinesulfinic acid can improve the storage stability of the emulsions in a refrigerator without affecting sensitivity to a large extent.

TABLE 3

| Sample No. | Emulsion | Formamidine-sulfinic acid* (mol/Ag mol) | $S_{1.5}$ 1st day | $S_{1.5}$ 60th day |
|---|---|---|---|---|
| A'-1 (Comp.) | a' | 0 | 100 | 150 |
| A'-2 (Inv.) | a' | 0.008 mmol | 100 | 104 |
| A'-3 (Inv.) | a' | 0.04 mmol | 100 | 103 |
| A'-4 (Inv.) | a' | 0.08 mmol | 101 | 102 |
| A'-5 (Inv.) | a' | 0.8 mmol | 102 | 103 |
| B-1 (Inv.) | b | 0.008 mmol | 125 | 130 |
| B-2 (Inv.) | b | 0.04 mmol | 125 | 130 |
| B-3 (Inv.) | b | 0.08 mmol | 126 | 130 |
| B-4 (Inv.) | b | 0.8 mmol | 127 | 131 |

While the invention has been described in detail and with reference to specific embodiments thereof, it will be apparent to one skilled in the art that various changes and modifications can be made therein without departing from the spirit and scope thereof.

What is claimed is:

1. A method for preparing a fogging type direct positive silver halide emulsion comprising the steps of:

(a) forming an emulsion containing silver halide grains;

(b) fogging surfaces of the grains with a reducing agent to form silver nuclei;

(c) performing at least one of an adjustment of pH of the emulsion to 4.5 or less and an adjustment of pAg of the emulsion to 8.1 or more; and then (d) adjusting the pH of the emulsion to a value within a range of 5.0 to 8.0 and/or adjusting the pAg of the emulsion to a value within a range of 7.8 to 5.5, to stabilize the silver nuclei.

2. The method as claimed in claim 1, wherein said fogging at step (b) is conducted at a pH of 4.8 or more and at a pAg of 8.0 or less.

3. The method as claimed in claim 2, wherein said fogging at step (b) is conducted at a temperature of 40° C. or more for two minutes or more.

4. The method as claimed in claim 1, wherein said fogging at step (b) is conducted at a pH of from 4.8 to 11, a pAg of from 5.0 to 8.0, and at a temperature of from 40° to 85° C. for from 2 to 200 minutes.

5. The method as claimed in claim 1, wherein said reducing agent used in step (b) is selected from the group consisting of formalin, hydrazine, a polyamine, thiourea dioxide, tetra(hydroxymethyl)phosphonium chloride, amine borane, a boron hydride compound, stannous chloride and tin (II) chloride.

6. The method as claimed in claim 1, wherein said reducing agent in step (b) is used in an amount of from $1.0\times10^{-6}$ to $1.0\times10^{-1}$ mol per mol of silver halide.

7. The method as claimed in claim 1, wherein the pH at step (c) is adjusted to 4.5 to 1.5.

8. The method as claimed in claim 1, wherein the pAg at step (c) is adjusted to 8.1 to 11.0.

9. The method as claimed in claim 1, wherein the time for performing step (c) is from 2 to 100 minutes.

10. The method as claimed in claim 1, wherein step (c) is performed at a temperature of from 25° to 80° C.

11. The method as claimed in claim 1, wherein step (c) is performed at a pH of from 4.5 to 1.5, a pAg of from 8.1 to 11.0, and a temperature of from 25° to 80° C. for from 2 to 100 minutes.

12. The method as claimed in claim 1, wherein after step (d), (e) a reducing agent is added into the emulsion at a temperature of 50° C. or lower to stabilize the Ag nuclei during storage.

13. The method as claimed in claim 12, wherein said reducing agent in step (e) is selected from the group consisting of formamidinesulfinic acid, hydrazine, a polyamine, formalin, phosphonium chloride, an amine borane compound, a boron hydride compound, stannous chloride, and tin chloride.

14. The method as claimed in claim 12, wherein said reducing agent in step (e) is incorporated in an amount of from $1\times10^{-8}$ to $1\times10^{-2}$ mole/mole Ag.

15. The method as claimed in claim 1, wherein step (d) is adjusting the pH of the emulsion to a value within a range of 5.0 to 8.0 to stabilize the silver nuclei.

16. The method as claimed in claim 1, wherein step (d) is adjusting the pAg of the emulsion to a value within a range of 7.8 to 5.5, to stabilize the silver nuclei.

17. The method as claimed in claim 1, wherein step (d) is adjusting the pH of the emulsion to a value within a range of 5.0 to 8.0 and adjusting the pAg of the emulsion to a value within a range of 7.8 to 5.5, to stabilize the silver nuclei.

* * * * *